United States Patent [19]

Olsen et al.

[11] 3,943,030

[45] Mar. 9, 1976

[54] APPARATUS FOR PRODUCING SUITCASE FRAMES

[75] Inventors: Harry Herbert Olsen; Mogens Ivan Hjort, both of Korsor, Denmark

[73] Assignee: Danalet Kuffertfabrik A/S, Denmark

[22] Filed: July 11, 1974

[21] Appl. No.: 487,685

[30] Foreign Application Priority Data

July 16, 1973 Denmark ..... 3927/73
Feb. 19, 1974 Spain ..... 423410

[52] U.S. Cl. ..... 156/446; 156/486
[51] Int. Cl.[2] ..... B65H 3/12
[58] Field of Search.... 156/189, 446, 468, 489–492, 156/259, 193, 486; 93/81 R, 94 PS

[56] References Cited

UNITED STATES PATENTS

| | | | |
|---|---|---|---|
| 1,278,898 | 9/1918 | Fernald | 156/446 |
| 2,218,027 | 10/1940 | Hatch | 156/193 X |
| 2,388,541 | 11/1945 | Henderson | 156/189 |
| 2,495,167 | 1/1950 | Horstman et al. | 156/193 X |
| 3,076,493 | 2/1963 | Berg | 156/446 |
| 3,190,783 | 6/1965 | Tarnok | 156/489 |

*Primary Examiner*—Douglas J. Drummond
*Assistant Examiner*—David A. Simmons
*Attorney, Agent, or Firm*—Browne, Beveridge, DeGrandi & Kline

[57] ABSTRACT

In an apparatus comprising a non-circular rotary mandrel on which a strip of paper or a similar sheet material is wound to form a multilayer tubular article, the material entering the mandrel is subjected to pressure thereagainst by means of a roller unit including at least two pairs of rollers. Both pairs of rollers are independently and pivotably suspended in a common carrier so that all of the rollers may continuously and independently apply a surface pressure to the material being wound onto the mandrel.

2 Claims, 1 Drawing Figure

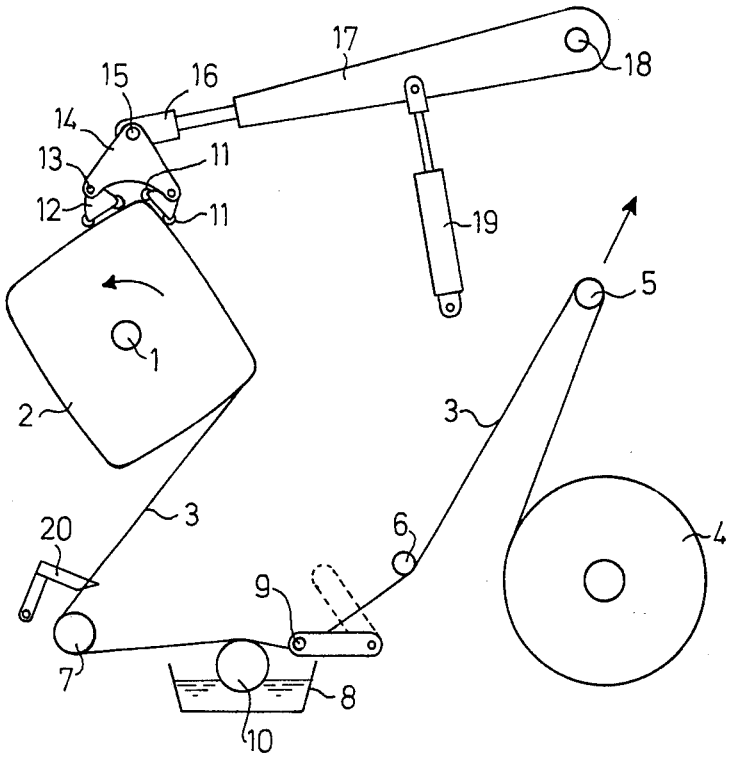
17
18
15
16
14
13
11
12
11
19
5
1
2
3
3
20
6
4
9
7
8
10

APPARATUS FOR PRODUCING SUITCASE FRAMES

The present invention relates to an apparatus for producing suitcase frames by winding a strip of material around a rotating mandrel while the consecutively following layers are being glued together.

In apparatuses of this type hitherto employed, the winding operation takes place without any appreciable stress or tightening occuring in the strip of material and, subsequent to the conclusion of the winding operation, the tubular body formed is pulled off the mandrel and subjected to a thermal pressing operation in another apparatus having a core which, in its shape, corresponds to that of the mandrel and which is surrounded by heated pressing dies. The glue hardens during the pressing operation whereby the frame formed is stabilized in the desired shape. Following this, the frame is normally divided by being sawed through into a wider and a narrower portion which are to be incorporated into the suitcase proper and its lid, respectively.

In efforts that have been made with a view to reducing the manufacturing costs it has been attempted to dispense with the separate thermal pressing operation of the wound blanks or articles, that is to say, by effecting the winding operation while considerably tightening the strip material in its longitudinal direction and by making use of a rapidly drying glue. However, these attempts have to be described as unseccessful in that it has turned out to be impossible to avoid uncontrollable distortions in the finished suitcase frames due to the variations in stress that are bound to arise in the course of the winding operation when the more or less rectangular mandrel rotates at constant speed.

Another proposal appears from the specification of U.S. Pat. No. 3,205,108, from which it is known to produce non-circular, tubular articles by winding a strip of material onto a rotating mandrel fitted with a pair of movable corner portions which, during the winding operation, are withdrawn into the mandrel and which are subsequently urged outwardly so as to impart to the wound material a circumferential tension that is, as far as possible, uniform. Subsequent hereto, a possibly heated clamping jacket is laid around the wound article while it still is on the mandrel, so as to eliminate the transfer of the article to a special apparatus for a subsequent pressing and hardening operation.

In contrast hereto, the apparatus according to the present invention comprises a roller unit serving to pressure-bias the wound material against the mandrel and including at least two pairs of freely rotable rollers that are parallel to the axis of rotation of the mandrel and are pivotably suspended in a common support that is displaceable towards and away from the mandrel and is, per se, pivotable around an axis that is parallel to the pivot axis of the pairs of rollers as well as to the axis of rotation of the mandrel.

It will be possible, when employing such a unit, to keep the individual rollers bearing permanently against the material being wound on the mandrel, irrespective of its more or less square shape. Thus, the material can be pressure-biased substantially perpendicular to its surface without any appreciable stresses being imparted to the material in the circumferential direction. When, at the same time, use is made of a glue possessing a sufficiently short hardening time, no finishing treatment of the suitcase frame will be required after the winding operation has been concluded, and the production may be substantially expedited and its costs reduced.

In addition, the roller unit makes it possible to dispense with the aforementioned sawing or cutting through the wound frame because a knife for longitudinally cutting through the strip of material to be wound may be provided adjacent the mandrel. The reason why this is possible without any risk that the suitcase body and lid frames obtained might not fit sufficiently accurately together, is that the roller unit exerts an absolutely uniform pressure bias on the two strip portions separated by means of the cutting operation without allowing the strip portions to be displaced relative to each other.

An embodiment of the apparatus according to the invention is shown schematically on the accompanying drawing.

A shaft 1 supported in the frame (not shown) of the apparatus carries a possibly heated mandrel 2 which rotates in the direction indicated by the arrow. In the course of the rotation, a suitable number of layers of a strip material 3 drawn from a feed roll 4 is wrapped or wound onto the mandrel 2. Due to the substantially rectangular shape of the mandrel 2, the speed of advance of the strip material varies, and, in order to obviate a slack in the strip material, this is conducted across a guide roller 5 which is spring or weight-biased in the direction of the arrow shown. The strip material 3 passes on further to the mandrel 2 across additional guide rollers 6 and 7, between which a conventional glue application mechanism 8 is mounted. In connection with glue application mechanism 8, a conventional, movable roller 9 is provided which, in the position shown with full lines, keeps the strip material 3 bearing against a glue application roller 10. When moved into the position shown with a line of dashes, a roller 9 permits the strip material to go clear of roller 10, thus interrupting the application of glue.

A roller unit comprising a total of four rollers 11 that are parallel to the axis of rotation of the mandrel 2 is fitted above the mandrel and serves to pressure-bias the material being wound. At their ends, each pair of rollers 11 is journalled in bearing plates 12 which, with the aid of pins 13, are pivotably suspended in a common support 14. Via an additional pivot pin 15 that is likewise parallel to the shaft 1 of the mandrel 2, this common support is connected to the outer end of an arm 17 which is pivoted on a shaft 18 mounted in the frame of the apparatus. The arm 17 is connected with a pneumatic cylinder 19 that serves to urge the roller unit against the mandrel 2 during the wrapping or winding operation and to subsequently lift the roller unit clear so that the suitcase frame formed can be removed from the mandrel.

Preferably, the end 16 of the arm 16, 17 may oscillate around its longitudinal axis so that the rollers 11, within certain limits, are able to adjust themselves by tilting also around this axis.

In the path between the guide roller 7 and the mandrel 2, the strip of material 3 passes a knife 20 which, in the position shown in the drawing, produces a longitudinal cut through the strip so that two separate frames are formed simultaneously on the mandrel 2 in close relationship to each other. These two frames may be incorporated in the body portion and the lid of a suitcase, respectively.

What is claimed is:

1. An apparatus for producing wound suitcase frames and comprising a mandrel having a substantially rectangular shape with rounded corner portions and journalled for rotation about a horizontal axis, means for carrying a feed roll of strip material to be wound around said mandrel by the rotation thereof, and a roller assembly including an elongated primary support member having one end pivotally mounted on an axis parallel to the axis of said mandrel, a pair of secondary support members pivotally mounted on said primary support member at the other end thereof for rotation about axes parallel to said axis of said mandrel, two pressure rolls mounted on each of said secondary support members for rotation about axes spaced from one another around said mandrel and parallel to the axis of said mandrel, and means resiliently urging said primary support member toward said mandrel to press each of said pressure rolls into contact with strip material being wound onto said mandrel.

2. An apparatus as claimed in claim 3 further comprising a knife mounted between said mandrel and said means carrying a feed roll for longitudinally cutting through the strip of material to be wound is provided adjacent the mandrel.

* * * * *